US010782013B1

(12) United States Patent
Cowen

(10) Patent No.: US 10,782,013 B1
(45) Date of Patent: Sep. 22, 2020

(54) REMOTE CONTROL CASE

(71) Applicant: David Cowen, Parkland, FL (US)

(72) Inventor: David Cowen, Parkland, FL (US)

( * ) Notice: Subject to any disclaimer, the term of this patent is extended or adjusted under 35 U.S.C. 154(b) by 0 days.

(21) Appl. No.: 16/716,675

(22) Filed: Dec. 17, 2019

(51) Int. Cl.
*F21V 33/00* (2006.01)

(52) U.S. Cl.
CPC ..... *F21V 33/0084* (2013.01); *F21V 33/0052* (2013.01); *F21V 33/008* (2013.01); *F21V 33/0056* (2013.01)

(58) Field of Classification Search
CPC ..... A61C 1/088; B43K 29/10; F21V 33/008; F21V 33/0084; F21V 33/0052; F21V 33/0056; G06F 3/02; G06F 3/01; G08C 23/04; G08C 23/06; H04N 5/4403
See application file for complete search history.

(56) References Cited

U.S. PATENT DOCUMENTS 4,991,892 A 2/1991 Burrell
5,031,791 A 7/1991 Serio, Jr.
5,055,977 A * 10/1991 Acquanetta ..... F21V 33/0052 362/109
5,265,720 A 11/1993 Meliconi
5,388,691 A 2/1995 White
5,422,783 A 6/1995 Darbee
5,790,021 A 8/1998 Mickel et al.
5,872,702 A 2/1999 Kopel
7,284,791 B1 10/2007 Wright
D733,074 S 6/2015 Kandler et al.
D733,100 S 6/2015 Kim
2013/0235616 A1* 9/2013 Tang ..... F21V 33/0052 362/611
2014/0110065 A1* 4/2014 Beland ..... F21V 33/008 160/66
2014/0131237 A1 5/2014 Nadalet

FOREIGN PATENT DOCUMENTS

WO WO 2007/137269 A2 11/2007

* cited by examiner

*Primary Examiner* — Y M. Quach Lee
(74) *Attorney, Agent, or Firm* — Jacqueline Tadros; Jacqueline Tadros, P.A

(57) ABSTRACT

A case for a remote control device having a body, the body including a cavity, wherein the cavity is configured to receive the remote control device. The body further including a first length positioned along a first side of the cavity and a second length positioned along a second side of the cavity, wherein the second length of the body is positioned at a distance from the first length of the body and opposite to the first length of the body. A first light source affixed and positioned along the first length of the cavity, wherein the first light source may be encased within a protective transparent sleeve. A housing receives and stores a power source and an electronic circuit board, coupled to the power source. The remote control case further includes at least one sensor.

19 Claims, 5 Drawing Sheets

REMOTE CONTROL CASE

BACKGROUND OF THE INVENTION

1. Field of the Invention

The present disclosure relates generally to a remote control case. More particularly, the invention relates to a case for storing a remote control, wherein the case includes an open cavity for receiving the remote control within the cavity and the remote control case is structured to cradle and partially encase the remote control for removable storage. The invention further includes a lighting system for illuminating control buttons on the remote control device, wherein the illuminating system may serve as a visual aid while using the remote control. The lighting system may also serve to identify or locate the remote control device.

2. Description of the Related Art

Remote control devices for electronically activating various apparatus or systems are well known in the art. Remote control devices are often used in situations where lighting is dim or non existent making it very difficult to locate the buttons necessary to activate and maneuver the remote control device. One such example is a remote control device for activating drapery and curtains. Another such example is a remote control device for activating a television set. Television viewers often reach for a remote control device while watching television in the dark, only to struggle to identify the buttons required to maneuver and activate the television set.

Remote control cases known in the art include U.S. Pat. No. 4,991,892 (to Burrell) for a holder for audio and video remote control, which includes a plurality of elongate support members to which at least one remote control can be attached. The elongate support members are spaced apart and attached to an integral body that forms gaps wide enough for a hand to grasp an individually attached remote control device. The attached remote control is supported in an upright position and is easy to locate.

The prior art also teaches U.S. Pat. No. 5,031,791 (to Serio, Jr.) an electronic enclosure case comprised of first and second case sections or so-called "shells" having mating abuttable rims. A plurality of spaced apart hooks extend outwardly from the rim on one of the case sections and are adapted for insertion into openings formed in the rim of the opposite case section. The hooks and the openings are sized and shaped so that the hooks will extend into the openings to enable the rims to abut against one another. When one of the case sections is thereafter moved in a plane parallel to the surface of the rims relative to the other case section, the hooks become latched in the opening and, there is a tight fitting retention of the two case sections so that the electronic enclosure casing cannot be unauthorizedly opened.

U.S. Pat. No. 5,872,702 (to Kopel) teaches a remote control holder having a mounting face to which several remote control units are attached using releasable fastening strips. The mounting face terminates in a curved frontal section enabling the holder to be hung on a television or other piece of furniture when not in use. A clear acrylic window fits over a label containing information, such as a cable guide.

One of the primary disadvantages of remote control cases or holders known in the art is that they do not provide the user with a means of maneuvering the buttons on the remote control device in situations wherein there is limited or no lighting to view the buttons, such as for example when using a remote control to open or close drapery or to activate a television or sound system in a dimly lit or dark environment.

In the context of cases for remote controls it is desirable to have a remote control case that removably secures a remote control device and also provides a lighting mechanism integrated within the case for illuminating buttons on the remote control device to allow a user to activate and maneuver the device in situations where there is limited or no lighting.

SUMMARY OF THE INVENTION

In accordance with the present invention, a remote control case of the present invention is disclosed. In one embodiment, the invention teaches a case for a remote control device having a body with an open cavity for receiving the remote control device within the cavity. The body of the case is preferably comprised of a plastic and/or rubber material and/or a combination or other suitable material, as may be readily appreciated by one reasonably skilled in the art. The case may be configured and dimensioned to receive the remote control device in a snug fit. Alternatively the case may include a means of attachment, for example a hook and loop attachment, to secure the remote control device within the cavity of the remote control case.

The invention further includes an electronic circuit board and one or more sensors positioned within the body of the case. The sensors may be touch capacitive sensors. In another embodiment, the sensors may be motion sensors or a combination of touch capacitive or motion sensors. A first end of the body includes an opening for receiving a first end of the remote control device. In one embodiment, the remote control device is slidably inserted into the cavity of the body by way of the opening positioned at a first end of the body. In one embodiment, there is a plurality of touch capacitive sensors positioned within the body of the case for activation by a user.

A second end of the body includes a compartment for receiving and housing a power source. In one embodiment, the power source is a battery. The power source may be an embedded rechargeable battery or a twelve volt battery or another suitable power source as will be appreciated by one reasonably skilled in the art. The power source is connected to the electronic circuit board and actuates the electronic circuit board, thereby activating the lighting source(s) and touch capacitive sensors. In one embodiment, the electronic circuit board is housed within the compartment with the battery.

Preferably, the case of the invention includes a light source positioned along a length of the body of the case. In one embodiment the light source is one or more light emitting diodes. In another embodiment a strip of light emitting diodes is the light source. The strip of light emitting diodes is positioned along a length of the body of the case. In yet another embodiments a first strip of light emitting diodes is positioned along a first length of the body of the case and a second strip of light emitting diodes is positioned along a second length of the body of the case.

In one embodiment, the light source is secured within a sleeve, wherein the sleeve is preferably comprised of a clear plastic or other transparent material. According to an embodiment, LED lights, or a strip of LED lights is secured within a clear plastic sleeve.

The light emitting diodes are positioned along one or more lengths of the case to allow light reflected from the light emitting diodes to be diverted in a direction towards buttons on a remote control device in order to illuminate the buttons to facilitate viewing buttons when the remote control is being used in a dimly lit or dark environment.

In a preferred embodiment, the body of the case is configured to provide a frame to shield a top of the light emitting diodes. The body of the case, thereby forming a frame or a cover further focuses light reflected from light emitting diodes towards buttons on the remote control device. Thus, the light emitting diodes are secured within a portion of the cavity of the body of the case such that the frame of the body shields light reflected from the light emitting diode and further diverts the light towards buttons on the remote control device.

The invention provides for the power source and electronic circuit board to activate the one or more sensors positioned within the body, thereby emitting light from the light source when the remote control contacts the case. The sensors may be touch capacitive or motion sensors, as will be readily appreciated by one reasonably skilled in the art.

In one embodiment the sensors are positioned beneath the illuminating source or LED lights. In another embodiment, the touch capacitors are positioned within the sleeve, beneath the illuminating source or LED lights. Thus light source or LED lights are activated when a portion of the light source contacts the touch capacitive sensors or activates the motion sensors. The light source may contact the touch capacitive sensors when the remote control is inserted into the case thereby exerting a pressure on the capacitive sensors.

Alternatively, the light source may contact the touch capacitive sensors when a user exerts pressure on the exterior body of the case in order to activate the light. Yet again, the light source may be activated by actuating the power source by exerting a pressure on the lid of the second end of the body of the case. The light source may also be activated, by pressing a button to actuate the power source.

In one embodiment, the light source may be activated with an application via a smart phone or another electronic device. Alternatively, the light source or LED's will turn on when a user's hand contacts the remote control case where the touch sensors are positioned, such as for example, a back of the remote control case. It is readily appreciated that touch sensors may be positioned along an inner portion of the case, including along a length of the case and/or a bottom of the case. Touching and/or applying pressure to the sensors or motion detection thereby activates the light source or LED lights.

The light source within the case may be programmed to emit light for a set period of time when activated. Thus, when a user activates the capacitive touch components, the light source within the case emits light for a set period of time.

An aspect of the invention is that it provides capacitive touch sensors to activate a light source to reflect light to illuminate buttons on a remote control device.

Another aspect of the invention is that it provides a plastic sleeve within which to secure the light source or LED lights.

Yet another aspect of the invention is that it includes a cover or frame to shield the light emitting from the light source in order to divert and direct the light toward buttons on the remote control and away from a user's face.

An object of the invention is to provide a case for a remote control device that protects the device and provides easy access to the buttons on the device in order to utilize the device.

An advantage of the invention is that it allows a user to recognize and maneuver buttons on a remote control device in a dimly lit or dark environment.

Another advantage of the invention is that the light source within the case may be activated via a software application in conjunction with a technological device, such as for example, a smart phone.

Yet another advantage of the invention is that the light source may be programmed to emit light for a set period of time when activated.

These and other aspects and advantages of the present disclosure will become apparent from the following detailed description of preferred embodiments of the invention considered in conjunction with the accompanying drawings, in which like drawings represent like components. It is to be understood, however, that the drawings are designed solely for purposes of illustration and not as a definition of the limits of the disclosure, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE INVENTION

DETAILED DESCRIPTION OF THE PREFERRED EMBODIMENTS

Figure 1:
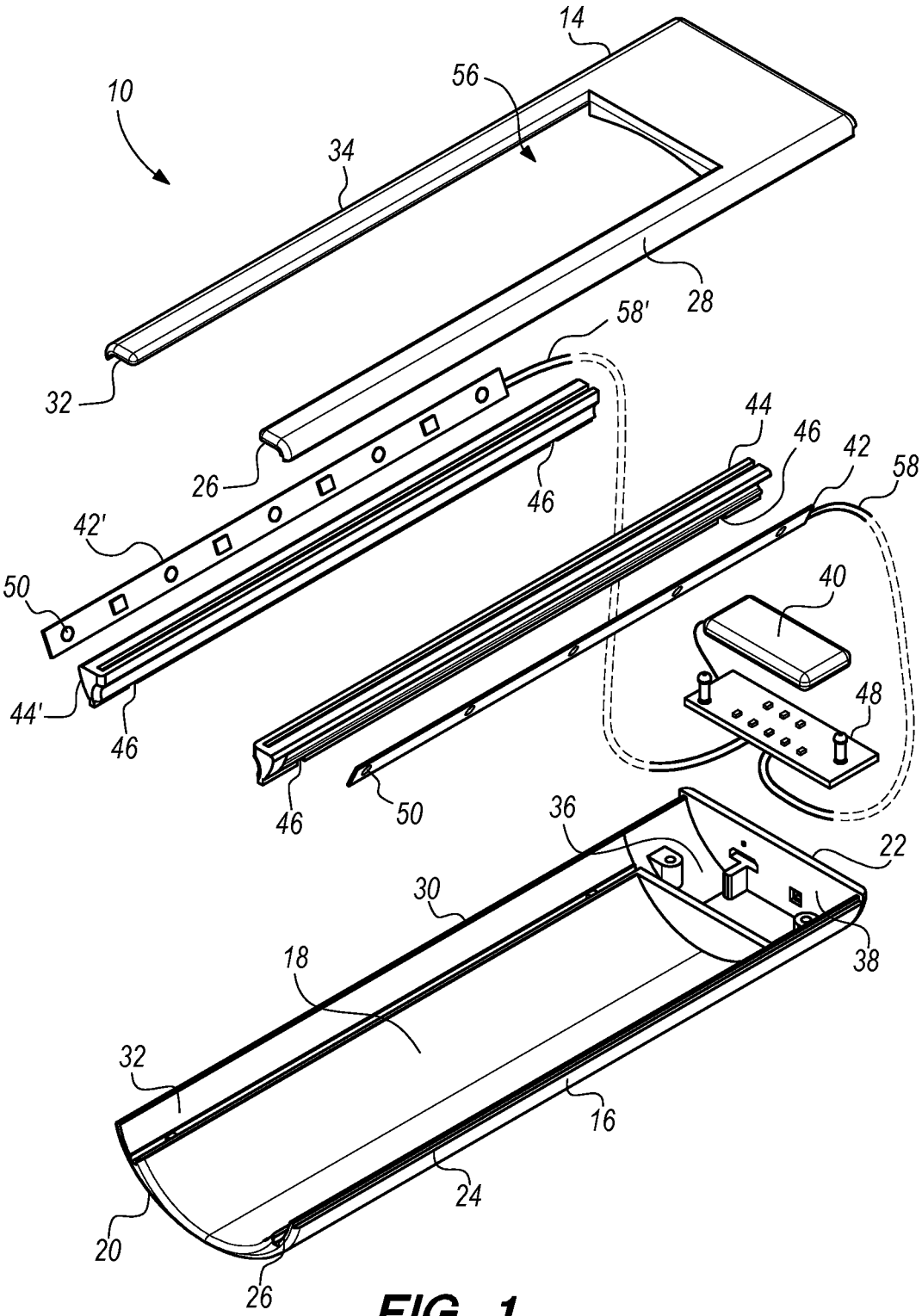
FIG. 1 is an exploded perspective view of the front of the remote control case of the present invention.

Referring now to FIGS. 1-6, there are shown illustrations of a remote control case 10 of the invention. The case 10 of the invention includes a body 12, the body 12 including a front cover 14 and a back cover 16, wherein the front cover 14 is affixed to the back cover 16. The body 12 further includes a cavity 18, wherein the cavity 18 of the body 12 is configured for receiving a remote control device 100 within the cavity 18. Preferably the body 12 of the case if composed of a plastic or rubber material or a combination thereof.

The front cover 14 includes a first arm 28 and a second arm 34 positioned on either side of an aperture 56 of the cavity 18.

In a preferred embodiment, the body 12 is a single unitary structure formed of a plastic or a rubber material formed by single injection molding or other suitable means as known by one reasonably skilled in the art. The body 12 includes a first end 20 and a second end 22 positioned at the base of the body 12, wherein the second end 22 is positioned opposite the first end 20. The body 12 further includes a first length 24 positioned within the cavity 18 of the body 12 and a second length 30 positioned within the cavity 18 along a second length 30 of the body 12 wherein the first length 24 is positioned a distance from the second length 30 and wherein each of the first length 24 and second length 30 are positioned on either side of the body 12 within the cavity 18.

The case 10 includes a compartment 36 for housing a power source 40 within the compartment 36. There is also shown a lid 38 for the compartment 36.

A first light source 42 is positioned within the cavity 18 along the first length 24 of the body 12. A second light source 42' is positioned within the cavity 18 along the second length 30 of the body 12. In one embodiment, the first 42 and second 42' light sources comprise one or more light emitting diodes. In a preferred embodiment, the first light source 42 and second light source 42' each comprise a strip of light emitting diodes. In yet another preferred embodiment, one or more of the first light source 42 and second light source 42', is secured within a first sleeve 44 and second sleeve 44'. The first sleeve 44 and second sleeve 44' in one embodiment are each comprised of clear plastic material or other transparent material.

A first channel 26 is formed along the first length 24 of the body 12 of the case 10. The first light source 42 secured within the first sleeve 44 is positioned within the first channel 26 includes. A second channel 32 is formed along a second length 30 of the body of the case. The second light source 42' secured within the second sleeve 44' is positioned within the second channel 32.

In an embodiment, the first arm 28 extends over the first light source 42 thereby directing light emitting from the first light source 42 when activated towards buttons 110 on the remote control device 100 for allowing a user to view the buttons 110 in a dimly lit or dark environment.

In a preferred embodiment, the second arm 34 extends over the second light source 42' thereby directing light emitting from the second light source 42' when activated towards buttons 110 on the remote control device 100 for allowing a user to view the buttons 110 in a dimly lit or dark environment.

The case 10 further includes a compartment 36 for housing a power source 40 for activating an electronic circuit board 48 within the case 10 and one or more sensors 50 positioned within the body 12 of the case 10. In one embodiment, the sensors 50 comprise touch capacitive sensors. In another embodiment, the sensors 50 may comprise motion sensors.

In one embodiment, the electronic circuit board 48 is housed within the compartment 36. In an embodiment, the sensors 50 are positioned within the case 10. In another embodiment, the sensors 50 are positioned within the first and second sleeves 44, 44' retaining the first and second light sources 42, 42'.

Referring now in particular to FIG. 1, there is shown an exploded perspective view of the front of the remote control case 10 of the present invention. There is shown the front cover 14. The front cover is generally planar 14 and includes the first arm 28 and the second arm 34 positioned on either side of the aperture 56 of the front cover 14. There is also shown the first channel 26 and second channel 32 formed beneath the first arm 28 and second arm 34 respectively.

There is also shown the back cover 16. The back cover 16 is generally concave to conform to the shape and size of the remote control device 100. It is appreciated by one reasonably skilled in the art that the shape and size of the back cover 16 may be adapted to conform to the shape and size of the remote control device 100. It is further appreciated by one reasonably skilled in the art that the body 12 of the case 10 may, and the cavity 18 may be adapted to conform to the shape and size of the remote control device 100.

The body 12 of the case 10 includes the first end 20 of the body 12 and the second end 22 of the body 12. There is shown the cavity 18 formed within the back cover 16. There is shown within the back cover 16, the housing 36 for the battery source 40 and the lid 38 for the housing 36. There is shown the first length 24 of the body 12 and the second length 30 of the body 12. There is shown the first channel 26 and the second channel 32.

FIG. 1 further shows the power source 40 and computer board 48. The first light source 42 and the second light source 42' and the first sleeve 44 and the second sleeve 44'. As shown in FIG. 1, the first sleeve 44 and second sleeve 44' each include indentations 46 for locking the first sleeve 44 and the second sleeve 44' to the back cover 16. There are further shown electrical connections 58 and 58' from the computer/electronic circuit board 48 to the LED strips 42 and 42'.

Figure 2:
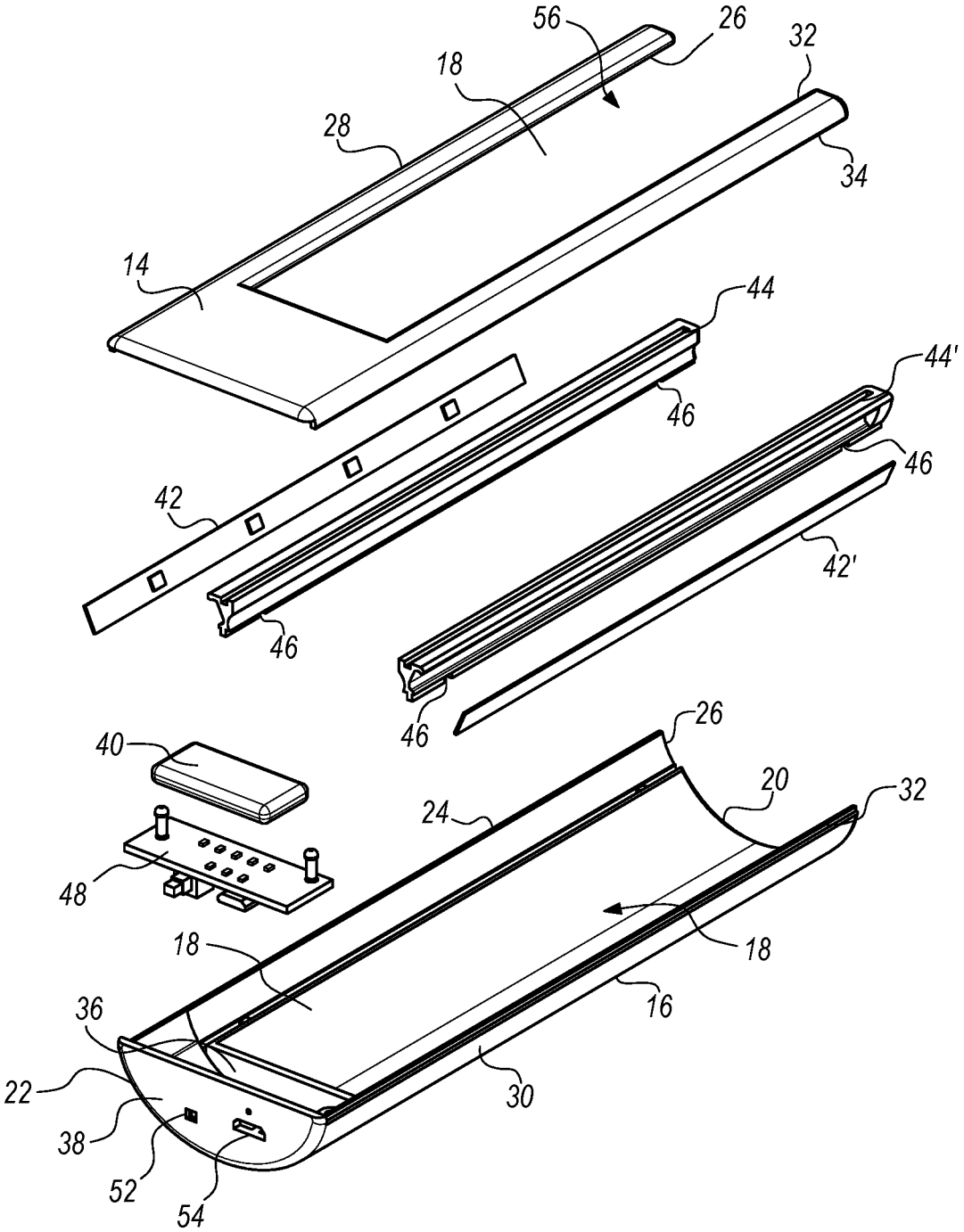
FIG. 2 is an exploded perspective view of the rear of the remote control case of the present invention.

Referring now in particular to FIG. 2 there is shown an exploded perspective view of the rear of the remote control case of the present invention. There is shown the front cover 14 including the first arm 28 and the second arm 34 on either side of the aperture 56. The first channel 26 and the second channel 32 are positioned beneath the first arm 28 and the second arm 34.

There is also shown the back cover 16. The back cover 16 is generally concave to conform to the shape and size of the remote control device 100. It is appreciated by one reasonably skilled in the art that the shape and size of the back cover 16 and cavity 18 may be adapted to conform to the shape and size of the remote control device 100.

The body 12 of the case 10 includes the first end 20 of the body 12 and the second end 22 of the body 12. There is shown the cavity 18 formed within the back cover 16. There is shown within the back cover 16, the housing 36 for the battery source 40 and the lid 38 for the housing 36. There is shown the first length 24 of the body 12 and the second length 30 of the body 12. There is shown the first channel 26 and the second channel 32.

FIG. 2 further shows the power source 40 and computer board 48. The first light source 42 and the second light source 42' and the first sleeve 44 and the second sleeve 44'. As shown, the first sleeve 44 and second sleeve 44' each include indentations 46 for locking the first sleeve 44 and the second sleeve 44' to the body 12 of the case 10.

There is further shown a battery disconnect safe button 52 and USB port 54 positioned on the lid 38 of the housing 36 positioned at the second end 22 of the body 12.

Figure 3:
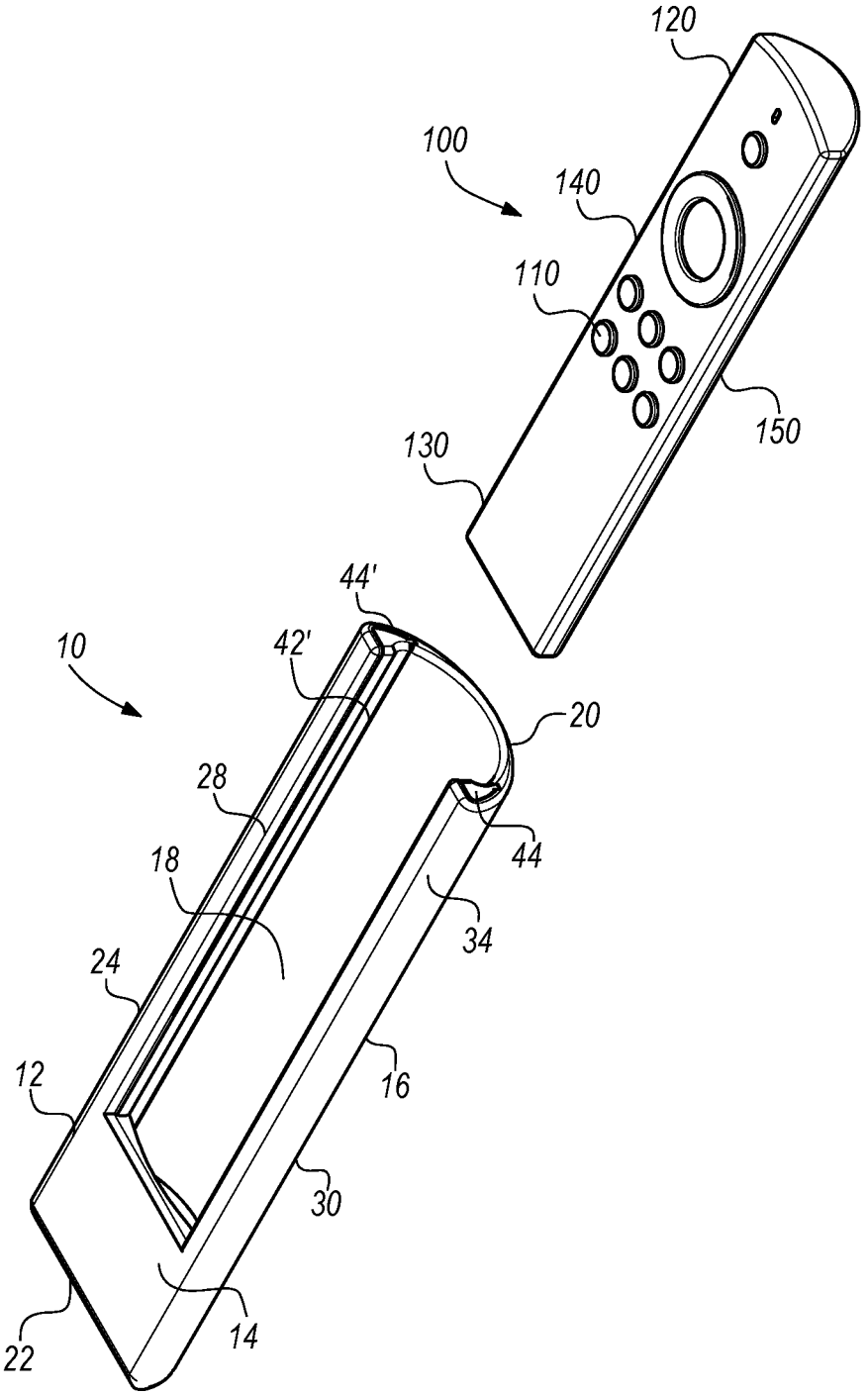
FIG. 3 is a perspective view of another embodiment of the remote control case of the present invention receiving a remote control device within the remote control case.

Referring now to FIG. 3, there is shown a perspective view of the remote control case 10 of the present invention receiving a remote control device 100 within the remote control case 10. In particular, there is shown a remote control device 100, the remote control device 100 including a plurality of buttons 110. The remote control device 100, further includes a first end 120 and a second end 130 of the remote control device 100. The remote control device 100 includes a first length 140 and a second length 150.

The remote control case 10 as shown in FIG. 3 illustrates the remote control device having a unitary body 12. The cavity 18 of the remote control case 10 is for receiving the remote control device 100. The remote control case 10 includes the first end 20 and the second end 30. The first length 24 of the body 12 is shown positioned at a distance from the second length 30 of the body 12.

The first arm 28 and the second arm 34 of the body 12 are positioned above the first light source 42 secured within the first sleeve 44 and the second light source 42' secured within the second sleeve 44' respectively.

Figure 4:
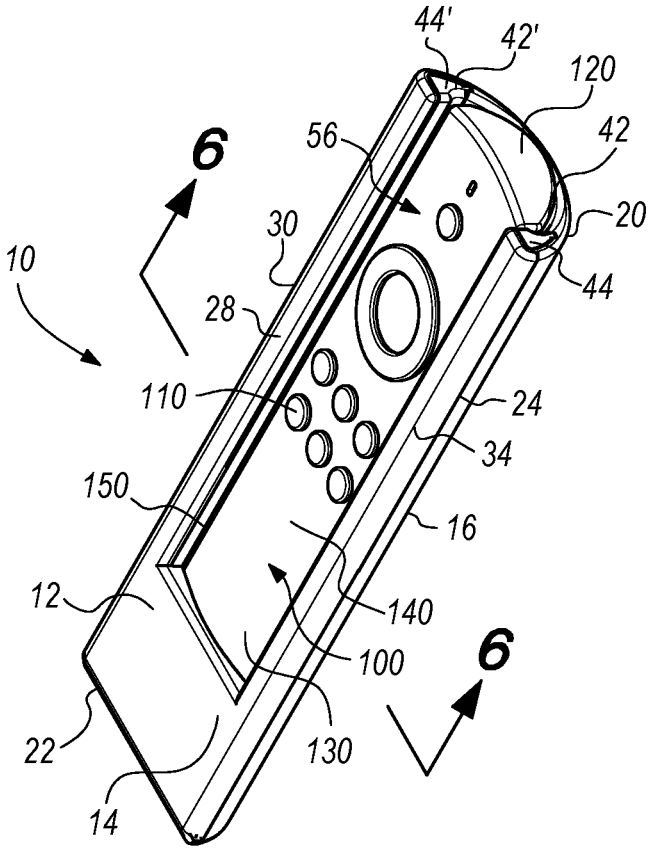
FIG. 4 is a perspective view of a remote control device fully inserted, and secured within the remote control case of the present invention.

Referring now to FIG. 4, there is shown a perspective view of a remote control device 100 inserted, and secured within the remote control case 10 of the present invention. The first end 120 of the remote control case 10 is proximate to the first end 20 of the body 12. The second end 130 of the remote control case 10 is proximate to the second end 22 of the body 12.

The buttons 110 of the remote control device 100 are accessible and visible within the aperture 56 of the remote control case 10. The front cover 14 includes the first arm 28 and the second arm 34 positioned at a distance from the first arm 28. The first light source 42 and the second light source 42' secured respectively in the first sleeve 44 and second sleeve 44' are positioned within the first channel 26 and second channel 32 respectively (shown in FIGS. 1 and 2), wherein the first channel 26 and second channel 32 are positioned beneath the top of the first arm 28 and the second arm 34 respectively.

The first light source 42 and the second light source 42' secured first sleeve 44 and second sleeve 44' respectively are each positioned along the first length 24 and the second length 30 of the body respectively.

Figure 5:
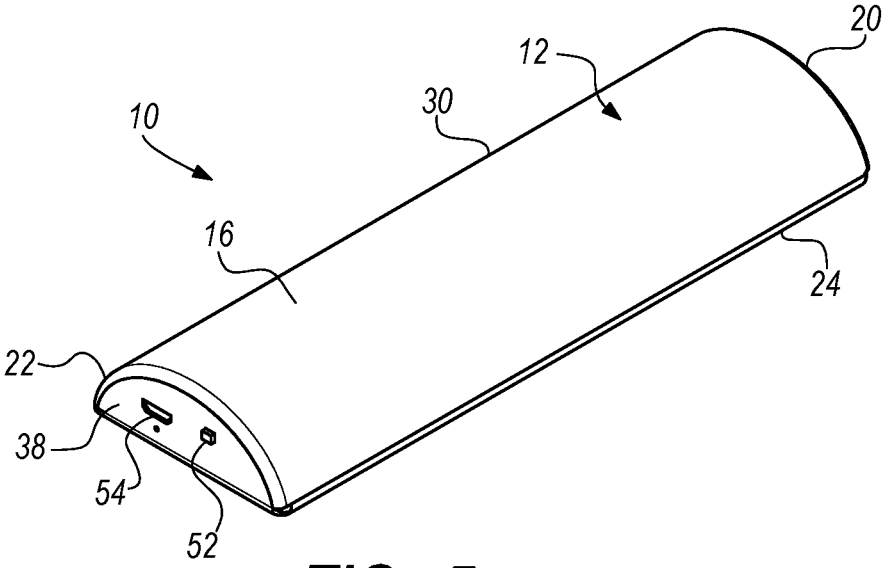
FIG. 5 is a rear perspective view of the back of the remote control case of the present invention.

Referring now to FIG. 5, there is shown a rear perspective view of the back of the remote control case 10 of the present invention. There is shown the back cover 16, the first end 20 and the second end 22 of the body 12. The lid 38 for the housing 36 for the power source 40, (shown in FIGS. 1-2) includes the battery disconnect safe button 52 and the USB port 54. The first length 24 is positioned at a distance of the second length 30 of the body 12.

Figure 6:
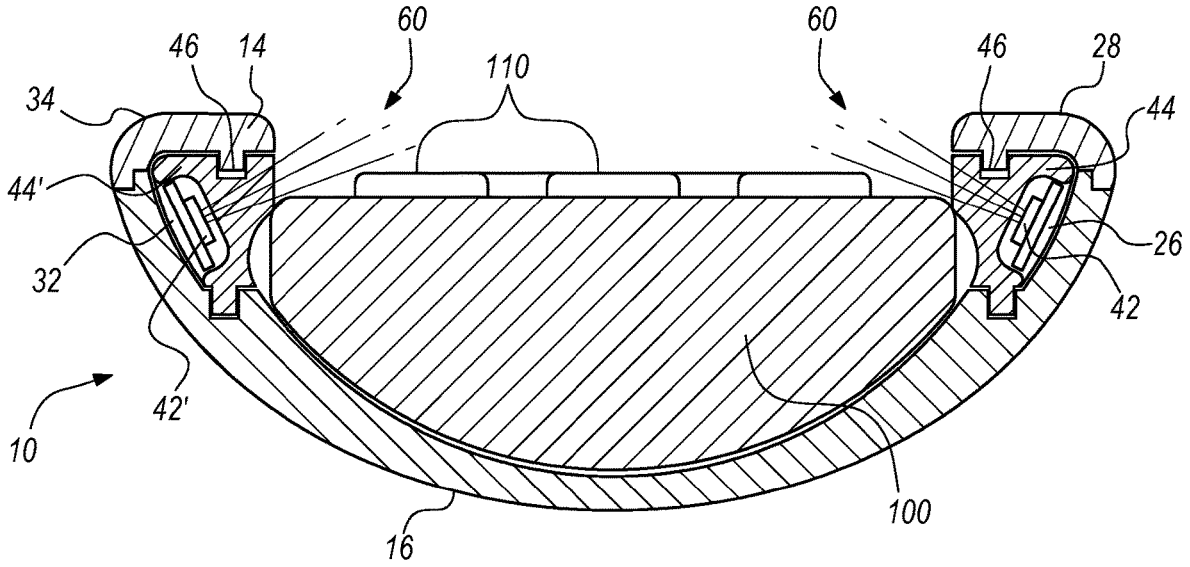
FIG. 6 is a cross sectional view taken along line 6-6 of FIG. 4 illustrating a remote control device inserted, and secured within the remote control case of the present invention.

Referring now to FIG. 6, there is shown a cross sectional view taken along line 6-6 of FIG. 4 illustrating a remote control device 100 inserted, and secured within the remote control case 10 of the present invention. The remote control device 100 is shown inserted within the remote control case 10.

As shown, light 60 from the first light source 42 within the first sleeve 44 and the light 60 from the second light source 42' within the second sleeve 44' reflects on the buttons 110. As shown, the first light source 42 within the first sleeve 44 and the light from the second light source 42' within the second sleeve 44' are positioned within the first channel 26 and the second channel 32 respectively.

The first sleeve 44 and second sleeve 44' each include indentations 46 for locking the first sleeve 44 and the second sleeve 44' to the body 12 of the case 10. The front cover 14 includes the first arm 28 and the second arm 34.

Thus, while there has been shown and described, fundamental novel features of the disclosure as applied to various specific embodiments thereof, it will be understood that various omissions and substitutions and changes in the form and details of the apparatus illustrated, and in their operation, may be made by those skilled in the art without departing from the spirit of the disclosure. For example, it is expressly intended that all combinations of those elements which perform substantially the same function, in substantially the same way, to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore to be limited only as indicated by the scope of the claims appended hereto.

What is claimed is:

1. A case for receiving a remote control device within the case, the case comprising:

a body, the body including a cavity, wherein the cavity is configured to receive the remote control device within the cavity; the body further including a back cover, a first side positioned along a first length of the cavity and an opposite facing second side positioned along a second length of the cavity, wherein the second side of the body is positioned at a distance from the first side of the body and wherein the second side is configured to be opposite facing to the first side of the body, such that the remote control device rests on the back cover and is positioned therebetween the first side of the body and the second side of the body, across a width of the remote control device, when the remote control device is inserted within the cavity;

a first light source affixed to the body and positioned along the first side of the body, such that the first light source is configured to be opposite facing the second side of the body, and such that light reflected from the first light source is directed upwards relative to the back cover;

a housing for receiving and storing a power source within the housing;

an electronic circuit board, wherein the electronic circuit board is coupled to the power source; and a sensor.

2. The case of claim 1, wherein a second light source is affixed to the body and positioned along the second side of the body, such that the second light source is configured to be opposite facing the first light source.

3. The case of claim 2, wherein the second light source is encased in a second protective transparent sleeve.

4. The case of claim 3, wherein the body includes a front cover and the back cover, and wherein the front cover includes a first arm and a second arm, the first arm being positioned at a distance from the second arm.

5. The case of claim 4, wherein the first arm, the first side and the back cover form a first channel for receiving the first light source therein, and wherein the second arm, the second side and the back cover form a second channel for receiving the second light source therein.

6. The case of claim 5, wherein a first transparent protective sleeve is configured to substantially occupy the entire first channel and the second transparent protective sleeve is configured to substantially occupy the entire second channel.

7. The case of claim 6 wherein a first top side of the first arm is configured to form a shield over the first light source, thereby directing and focusing light reflected from the first light source towards buttons positioned on the remote control device, for illuminating the buttons on the remote control device, for viewing the buttons in a dimly lit or dark environment.

8. The case of claim 7 wherein a second top side of the second arm is configured to form a shield over the second light source, thereby directing and focusing light reflected from the second light source towards buttons positioned on the remote control device, for illuminating the buttons on the remote control device, for viewing the buttons in a dimly lit or dark environment.

9. The case of claim 8, wherein the body is formed of a single unitary structure.

10. The case of claim 8, wherein a first transparent protective sleeve and second transparent protective sleeve, each further includes indentations; whereby the indentations interlock the first transparent protective sleeve to the body along an underside of the first top side of the first arm, and the indentations interlock the second transparent protective sleeve to the body along an underside of the second top side of the case.

11. The case of claim 6, wherein the sensor is a touch capacitive sensor, and wherein the touch capacitive sensor is positioned within the first transparent protective sleeve such that when the remote control is slidably inserted into the cavity of the case, pressure is exerted on the touch capacitive sensor, thereby activating the first light source to emit light.

12. The case of claim 1, wherein the sensor is a motion sensor.

13. The case of claim 1, wherein the sensor is positioned within the body.

14. The case of claim 1, further including a plurality of sensors, wherein the plurality of sensors are positioned proximate to the first light source.

15. The case of claim 1, wherein the first light source is encased within a first transparent protective sleeve.

16. The case of claim 1, wherein the electronic circuit board is programmed to turn off the first light source after a predetermined time.

17. The case of claim 1, wherein the light source is a light emitting diode.

18. The case of claim 1, wherein the light source is a light emitting diode strip.

19. The case of claim 1, whereby light reflected from the first light source is further directed across a top face of the remote control device.

* * * * *